US009250588B1

(12) United States Patent
Nakajima

(10) Patent No.: US 9,250,588 B1
(45) Date of Patent: Feb. 2, 2016

(54) FIXING DEVICE AND IMAGE FORMING APPARATUS INCLUDING THIS

(71) Applicant: KYOCERA Document Solutions Inc., Osaka (JP)

(72) Inventor: Eiji Nakajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/434,946

(22) PCT Filed: Aug. 27, 2014

(86) PCT No.: PCT/JP2014/072407

§ 371 (c)(1),
(2) Date: Apr. 10, 2015

(87) PCT Pub. No.: WO2015/075987

PCT Pub. Date: May 28, 2015

(30) Foreign Application Priority Data

Nov. 21, 2013 (JP) ..... 2013-240742

(51) Int. Cl.
*G03G 15/20* (2006.01)

(52) U.S. Cl.
CPC ..... *G03G 15/2085* (2013.01)

(58) Field of Classification Search
USPC ..... 399/122, 320, 328, 329–333; 219/216, 219/619
See application file for complete search history.

(56) References Cited

U.S. PATENT DOCUMENTS 7,853,190 B2 * 12/2010 Shimizu ..... G03G 15/2053 399/329
8,559,858 B2 * 10/2013 Murakami ..... G03G 15/2053 399/323
8,666,268 B2 * 3/2014 Watanabe ..... G03G 15/205 219/216

FOREIGN PATENT DOCUMENTS

JP 2010-145958 A 7/2010

OTHER PUBLICATIONS

International Search Report; PCT/JP2014/072407; Oct. 7, 2014.
Written Opinion of the International Searching Authority; PCT/JP2014/072407; Oct. 7, 2014.

* cited by examiner

*Primary Examiner* — Hoan Tran
(74) *Attorney, Agent, or Firm* — Studebaker & Brackett PC

(57) ABSTRACT

A fixing device (15) of the present invention includes a fixing roller (30) having a fixing belt (35) heated by a heat source (32) around an outer circumference of an elastic layer (34) provided around a core metal (33); and a pressuring roller (31) provided so as to pressure-contact with the fixing roller (30) and to form a fixing nip (N) passing a recording medium (P) having a toner image transferred through, wherein, in both end faces (S1) in an axial direction of the elastic layer (34), annular gaps (70) are recessed separate from the core metal (33) and fixing belt (35) along a circumference direction, bottom parts (71) of the annular gaps (70) are configured so as to be positioned inside both end faces (S3) in the axial direction of the pressuring roller (31).

6 Claims, 4 Drawing Sheets

FIXING DEVICE AND IMAGE FORMING APPARATUS INCLUDING THIS

TECHNICAL FIELD

The present invention relates to a fixing device fixing a toner image onto a recording medium and an image forming apparatus including this.

BACKGROUND ART

An electrographic image forming apparatus, such as a copying machine or a printer, includes a fixing device fixing a toner image onto a recording medium, such as a sheet. The general fixing device includes a fixing roller having an elastic layer formed around an outer circumference of a core metal, a pressuring roller pressure-contacting with this and a heating device arranged inside or outside the fixing roller. Such a fixing device is configured so as to fix a heated and melted toner onto the sheet by passing the sheet having the toner image transferred through a fixing nip formed between respective rotating rollers.

In the general fixing device, surface hardness of the fixing roller (the elastic layer) is set lower (softer) than surface hardness of the pressuring roller. In recent years, for purposes of acceleration of image forming, a pressing force of the pressuring roller is set high. It is because a distance of the fixing nip is lengthened by greatly deforming the soft fixing roller (the elastic layer). In this case, because the elastic layer is also greatly deformed in an axial direction, there was a problem that stress is concentrated on an interface between the core metal and elastic layer and the elastic layer is peeled from the core metal at both end parts in the axial direction.

In order to solve such a problem, as shown in FIG. 4, a fixing device 100 is proposed, which includes a fixing roller 101 having an endless belt 105 provided around a core metal 103 via an elastic layer 104 and a pressuring roller 102 pressure-contacting with this to form a nip part 106, and has stepped down parts G, in which parts contacting with the endless belt 105 are cut off at both end parts of the elastic layer 104 of the fixing roller 101 (refer to Patent Document 1). This fixing device is configured so as to restrain interfacial peeling of the elastic layer 104 from the core metal 103 because both end parts of the elastic layer 102 being the stepped down parts are not pressured by the pressuring roller 104.

PRIOR ART DOCUMENT

Patent Document

[PATENT DOCUMENT 1] Japanese patent laid-open publication No. 2010-145958

SUMMARY OF INVENTION

Problems to be Solved by the Invention

However, the above-mentioned fixing device 100 cannot receive pressure from the pressuring roller 102 at both end parts of the elastic layer 104 being the stepped down parts G. Because of this, both end parts of the endless belt 105 facing to the stepped down parts G become a state being bent to a side of the elastic layer 104 in the nip part 106 (refer to FIG. 4). When rotation of the respective rollers 101 and 102 is advanced and the bent endless belt 105 is passed through the nip part 106, the bent endless belt 105 is returned by its own elastic force. Therefore, because the both end parts of the endless belt 105 are repeatedly bent according to the rotation of the respective rollers 101 and 102, there was a possibility of causing a crack at a bent portion. Because of this, there was a problem that a lifetime of the fixing roller 101 is shortened.

The present invention is provided to solve the above-mentioned problems and its object is to provide a fixing device being capable of restraining damage of a fixing roller according to increase of pressure from the pressuring roller and an image forming apparatus including this.

Means for Solving the Problem

A fixing device of the present invention includes a fixing roller having a fixing belt heated by a heat source around an outer circumference of an elastic layer provided around a core metal; and a pressuring roller provided so as to pressure-contact with the fixing roller and to form a fixing nip passing a recording medium having a toner image transferred through, wherein, in both end faces in an axial direction of the elastic layer, annular gaps are recessed separate from the core metal and fixing belt along a circumference direction, bottom parts of the annular gaps are configured so as to be positioned inside both end faces in the axial direction of the pressuring roller.

Moreover, an image forming apparatus of the present invention includes the above-mentioned fixing device.

Effects of the Invention

In accordance with the present invention, it is possible to restrain interfacial peeling of an elastic layer from a core metal and to prevent a fixing belt from being damaged, and to achieve lifetime prolongation of a fixing roller.

MODES FOR CARRYING OUT THE INVENTION

In the following, an embodiment of the present invention will be described with reference to the appended drawings. Incidentally, in the following description, for convenience, arrows Fr indicated in FIG. 1 and FIG. 2 is defined as a front face side (a front side) of a color printer.

Figure 1:
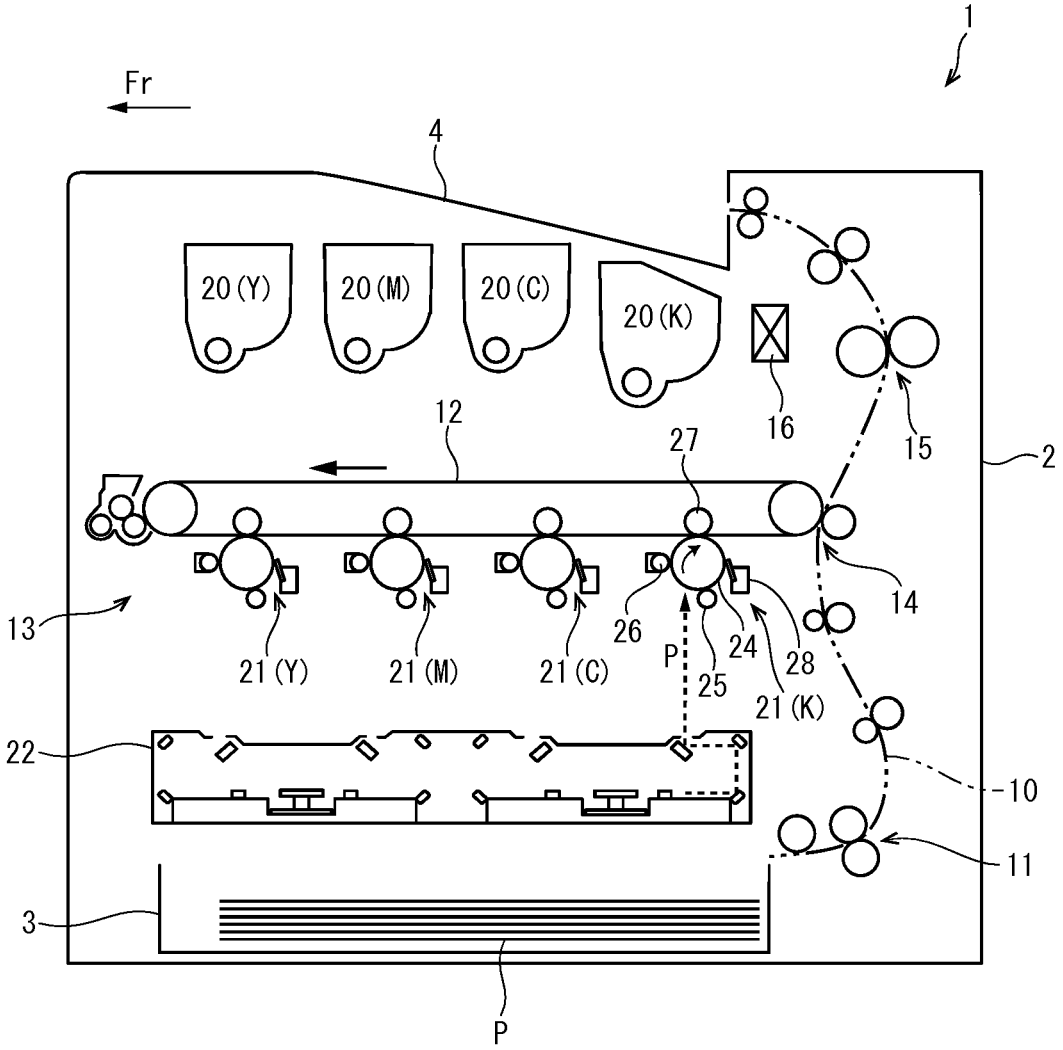
FIG. 1 It is a schematic diagram schematically showing an inner structure of a color printer in accordance with an embodiment of the present invention.
Figure 2:
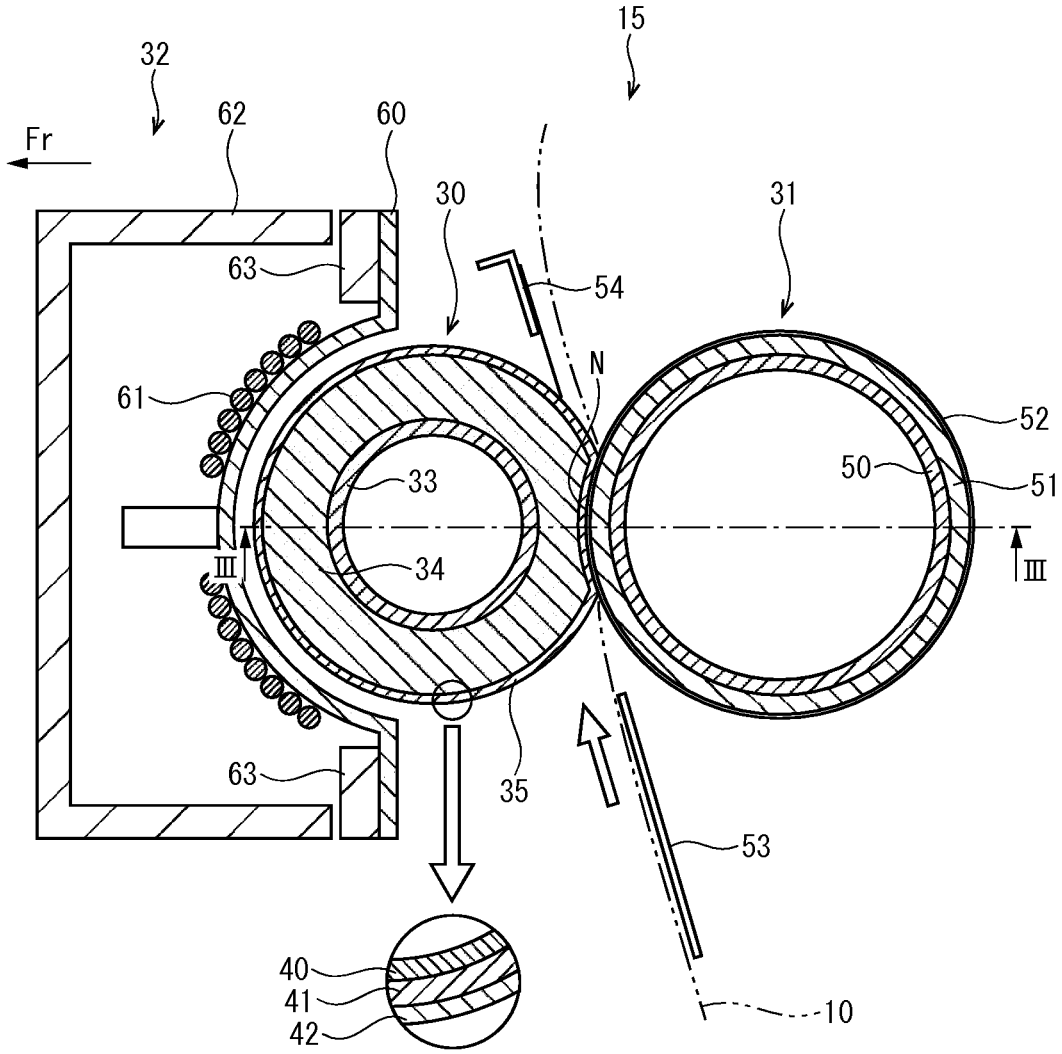
FIG. 2 It is a sectional view schematically showing a fixing device in accordance with an embodiment of the present invention.

With reference to FIG. 1, an entire structure of a color printer 1 as an image forming apparatus will be described. Here, FIG. 1 is a schematic diagram schematically showing an inner structure of the color printer 1.

The color printer 1 includes an apparatus main body 2 constituting a main appearance, a sheet feeding cartridge 3 provided in a lower part of the apparatus main body 2 to store a sheet P as a recording medium and an ejected sheet tray 4 provided in a top face of the apparatus main body 2. Incidentally, the recording medium is not restricted by a paper-made sheet P, may be a resin film, an OHP sheet or others.

The color printer 1 includes a sheet feeding part 11 feeding the sheet P set in the sheet feeding cartridge 3 to a conveyance path 10, an image forming part 13 first-transferring a toner image onto an intermediate transferring belt 12, a second transferring nip part 14 second-transferring the first-transferred toner image onto the sheet P, a fixing device 15 fixing the second-transferred toner image onto the sheet P and a controlling device 16 controlling each device, inside the apparatus main body 2.

The image forming part 13 is configured so as to carry out image forming by using replenishment toners of four colors (yellow (Y), magenta (M), cyan (C), black (B)) contained in four toner containers 20. The image forming part 13 is configured to include four drum units 21 and an exposure device 22 irradiating a laser light (refer to an arrow P indicated in FIG. 1) onto surfaces of respective photosensitive drums 24.

The four drum units 21 are arranged in parallel in forward and backward directions at a lower side of the intermediate transferring belt 12. Each drum unit 21 is configured to include a photosensitive drum 24 as an image carrier supported rotatably, and a charging device 25, a developing device 26, a first transferring roller 27 and a cleaning unit 28 arranged around the photosensitive drum 24 in order of transferring processes.

Now, image forming process by the color printer 1 will be described. When the power is supplied to the color printer 1, the controlling device 16 initializes various parameters, such as temperature setting of the fixing device 15. When direction of a printing start and input of image data are carried out from a personal computer or the like connected with the color printer 1, the controlling device 16 executes image forming process as follows.

First, to the surface of each photosensitive drum 24 charged at a predetermined electrical potential by each charging device 25, exposure corresponding to the image data is carried out by each exposure device 22. An electrostatic latent image thereby formed onto each photosensitive drum 24 is developed to the toner image by the toner of each color supplied from each toner container 20 to each developing device 26. When a bias is applied to each first transferring roller 27, the toner image of each color is first-transferred onto the intermediate transferring belt 12 in order to form the toner image of full color on the intermediate transferring belt 12. On the other hand, the sheet P fed from the sheet feeding cartridge 3 by the sheet feeding part 11 is conveyed to the second transferring nip part 14 through the conveyance path 10. Subsequently, when a bias is applied to the second transferring nip part 14, the toner image of full color is second-transferred onto the sheet P. This sheet P is subjected to fixing process in the fixing device 15, and then, ejected onto the ejected sheet tray 4. Incidentally, the toner remained on each photosensitive drum 24 is removed by the cleaning unit 28.

Figure 3:
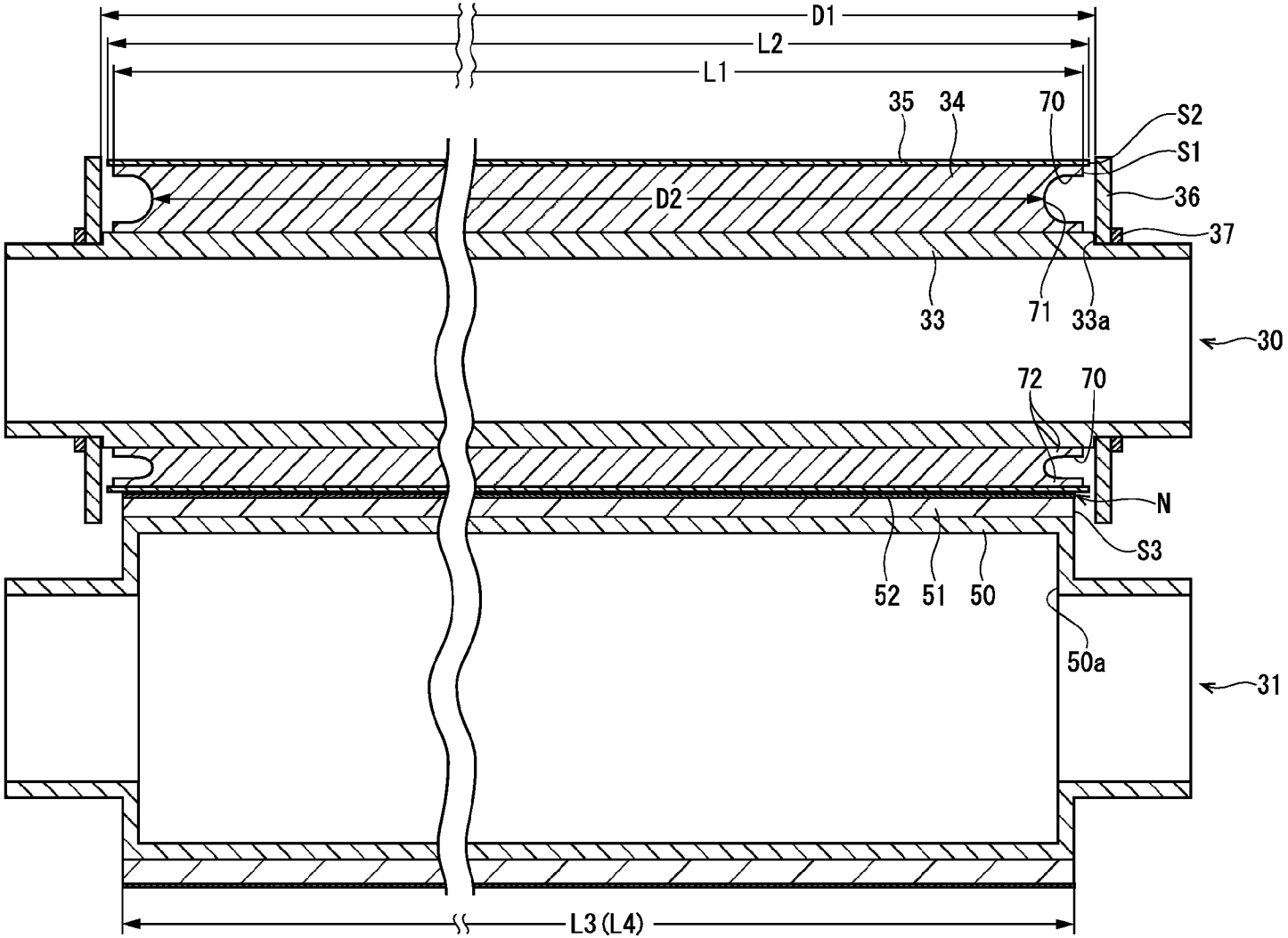
FIG. 3 It is a III-III sectional view in FIG. 2.
Figure 4:
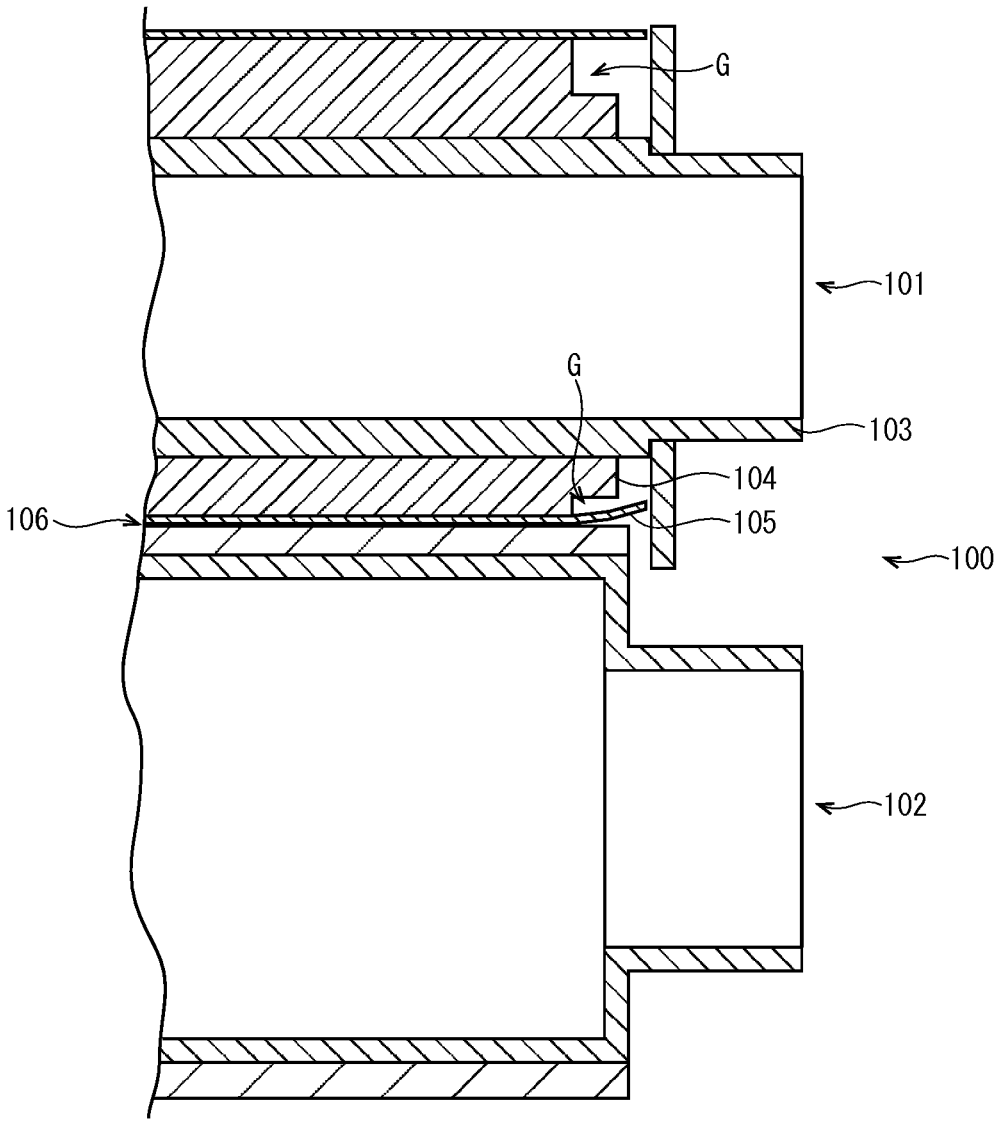
FIG. 4 Related Art
FIG. 4 It is a sectional view schematically showing a part of a fixing device of a related art.

Next, with reference to FIG. 2 and FIG. 3, the fixing device 15 will be described. FIG. 2 is a sectional view schematically showing the fixing device 15. FIG. 3 is a III-III sectional view in FIG. 2.

As shown in FIG. 2, the fixing device 15 is configured to include a fixing roller 30, a pressuring roller 31 and an IH (Induction Heating) fixing unit 32.

As shown in FIG. 2 and FIG. 3, the fixing roller 30 is formed in a columnar shape elongated in left and right directions (an axial direction). The fixing roller 30 has a fixing side elastic layer 34 provided around an outer circumference of a fixing side core metal 33 and a fixing belt 35 provided around an outer circumference of the fixing side elastic layer 34. Incidentally, the fixing belt 35 is rotated according to rotation of the fixing side core metal 33 and fixing side elastic layer 34.

The fixing side core metal 33 is formed in a hollow cylindrical shape, for example, by metal material, such as stainless steel or aluminum. Both left and right end parts of the fixing side core metal 33 are rotatably supported by a pair of bearings (not shown) provided in the apparatus main body 2. Both left and right end parts of the fixing side core metal 33 are formed in a small diameter to have stepped parts 33*a* (refer to FIG. 3).

As shown in FIG. 3, in both left and right end parts of the fixing side core metal 33, deviation preventing flanges 36 extending to the outside in a radial direction are arranged, respectively. Each deviation preventing flange 36 is formed in an annular shape. Each deviation preventing flange 36 is fitted from an end face of the fixing side core metal 33 toward the inside in the axial direction until coming into contact with the stepped part 33*a* and arranged in a retained state by fitting a stop ring 37 around an end part of the fixing side core metal 33. Each deviation preventing flange is attended relative-rotatably to the fixing side core metal 33.

The fixing side elastic layer 34 is provided around the outer circumference of the fixing side core metal 33 between a pair of left and right stepped parts 33*a*. In detail, a length L1 in the axial direction (the left and right directions) of the fixing side elastic layer 34 is configured slightly shorter than a distance D1 between the pair of left and right stepped parts 33*a* (the deviation preventing flanges 36). The fixing side elastic layer 34 is formed, for example, by a material having heat resisting property and elasticity with a thickness of 10 mm, such as a silicone sponge. Incidentally, the above-mentioned thickness of the fixing side elastic layer 34 is one example, may be suitably changed.

The fixing belt 35 is provided around the fixing side elastic layer 34. In detail, a length L2 in the axial direction (the left and right directions) of the fixing belt 35 is configured slightly shorter than the distance D1 between the pair of left and right stepped parts 33*a* (the deviation preventing flanges 36) and slightly longer than the length L1 in the axial direction of the fixing side elastic layer 34.

As shown in FIG. 2, the fixing belt 35 is composed of, for example, a belt side elastic layer 41 provided around a base material 40 and a belt side release layer 42 covering the belt side elastic layer 41.

The base material 40 is formed, for example, by a metal material with a thickness of 30 μm-40 μm, such as nickel. The belt side elastic layer 41 is formed, for example, by a material having heat resisting property and elasticity with a thickness of 200 μm-300 μm, such as a silicone rubber. The belt side release layer 42 is formed, for example, by a PFA tube with a thickness of 30 μmm. Incidentally, the above-mentioned thickness of the base material 40, belt side elastic layer 41 and belt side release layer 42 are one example, may be suitably changed, respectively.

As shown in FIG. 2 and FIG. 3, the pressuring roller 31 is formed in a columnar shape elongated in left and right directions. The pressuring roller 31 has a pressuring side release layer 52 provided around a pressuring side core metal 50 via a pressuring side elastic layer 51.

The pressuring side core metal 50 is formed in a hollow cylindrical shape, for example, by metal material, such as stainless steel or aluminum. Both left and right end parts of the pressuring side core metal 50 are rotatably supported by a pair of bearings (not shown) provided in the apparatus main body 2. Both left and right end parts of the pressuring side core metal 50 are formed in a small diameter to have stepped parts 50*a* (refer to FIG. 3).

As shown in FIG. 3, the pressuring side elastic layer 51 is provided around the outer circumference of the pressuring side core metal 50 between a pair of left and right stepped parts 50*a*. In detail, a length L3 in the axial direction (the left and right directions) of the pressuring side elastic layer 51 is configured roughly equal to a distance between the pair of left and right stepped parts 50*a* and slightly shorter than the length L1 in the axial direction of the fixing side elastic layer 34. The pressuring side elastic layer 51 is formed, for example, by a material having heat resisting property and elasticity with a thickness of 2.0 mm, such as a silicone rubber.

The pressuring side release layer 52 is provided around an outer circumference of the pressuring side elastic layer 51. A length L4 in the axial direction (the left and right directions) of the pressuring side release layer 52 is roughly equal to the length L3 in the axial direction of the pressuring side elastic layer 51. The pressuring side release layer 52 is formed, for example, by a PFA tube with a thickness of 0.05 mm. Incidentally, the above-mentioned thickness of the pressuring side elastic layer 51 and pressuring side release layer 52 are one example, may be suitably changed, respectively.

The above-mentioned pressuring roller 31 is configured so as to be driven and rotated by drive mechanism (a motor, a gear train and others), which of illustration is omitted. The fixing roller 30 is configured so as to be pressed to the pressuring roller 31 by a biasing force of a biasing part (not shown) and to be co-rotated in an opposite direction to the pressuring roller 31. Incidentally, it may be configured so as to drive and rotate the fixing roller 30 and to co-rotate the pressuring roller 31.

As shown in FIG. 2 and FIG. 3, the pressuring roller is provided so as to pressure-contact with the fixing roller 30 and to form a fixing nip N passing the sheet P having toner image transferred through. The fixing nip N is formed between the fixing roller 30 and pressuring roller 31 along the conveyance path 10 of the sheet P. In addition, since surface hardness of the fixing roller 30 (mainly, hardness of the fixing side elastic layer 34 and belt side elastic layer 41) is set lower (softer) than surface hardness of the pressuring roller 31 (mainly, hardness of the pressuring side elastic layer 51), in the fixing nip N, the fixing roller 30 is crushed. That is, in the fixing nip N, the fixing side elastic layer 34 and fixing belt 35 are displaced greatly in the radial direction.

Incidentally, in the fixing nip N, the fixing side elastic layer 34 and fixing belt 35 are also displaced greatly in the axial direction. However, the displacement in the axial direction is restricted by a pair of left and right deviation preventing flanges 36.

At an entry side of the sheet P in the fixing nip N, an entering guide 53 is arranged. The entering guide 53 is located at a side of the pressuring roller 31 and arranged so as to guide the sheet P conveyed in the conveyance path 10 to the fixing nip N. In addition, at a transmission side of the sheet P in the fixing nip N, a separation plate 54 is arranged. The separation plate 54 is biased to a side of the fixing belt 35 by a biasing part (not shown). A distal end part of the separation plate 54 is provided to separate slightly from an outer circumference face of the fixing belt 35. The sheet P passing through the fixing nip N is adapted to be released from the fixing belt 35 by the separation plate 54. Incidentally, although illustration is omitted, near the fixing roller 30, a temperature sensor (a thermistor) detecting temperature of the fixing belt 35 is provided.

As shown in FIG. 2, the IH fixing unit 32 is provided as a heat source heating the fixing belt 35 at an opposite side to the fixing nip N across the fixing roller 30. The IH fixing unit 32 includes a roughly half cylindrical bobbin 60 covering the fixing roller 30, an IH coil 61 supported by the bobbin 60, and an arch core 62 and a pair of side cores 63 provided so as to cover the IH coil 61.

The IH coil 61 is located at an opposite side to the fixing belt 35 across the bobbin 60. That is, the IH fixing unit 32 is configured as co-called "external enveloping IH". The arch core 62 and the pair of side cores 63 is composed of, for example, ferrite. The respective cores 62 and 63 are provided to form a magnetic path having a magnetic flux produced from the IH coil 61 passed through.

The controlling device 16 provided in the color printer 1 is configured to include a CPU (Central Processing Unit), a storing part, such as a ROM (Read Only Memory) and RAM (Random Access Memory), an interface and others (not shown all). The controlling device 16 is connected to each device including the fixing device 15 of the color printer 1. The controlling device 16 is configured so as to integrally control the color printer 1 on the basis of program and data stored in the storing part.

Now, an action of the fixing device 15 will be described.

The controlling device 16 controls and drives the IH fixing unit 32 (the IH coil 61) on the basis of detection result of the temperature sensor. In detail, the controlling device 16 transmits a drive signal to a coil driving part (not shown) and the coil driving part supplies high frequency current to the IH coil 61. Thereby, the fixing belt 35 is heated by a high frequency magnetic field produced in the IH coil 61. Moreover, the controlling device 16 controls and drives the drive mechanism to rotate the pressuring roller 31. Thereby, the fixing roller 30 forming the fixing nip N with the pressuring roller 31 is co-rotated.

In the image forming process, the sheet P having the toner image transferred is passed through the fixing nip N and subjected to the fixing process. In detail, the sheet P is heated by the fixing roller 30 (the fixing belt 35) and pressed by the pressuring roller 31 when passing through the fixing nip N. Thereby, the toner on the sheet P is heated and pressured to be fixed onto the sheet P.

Incidentally, in the color printer 1, since acceleration of the image forming process is desired, rotation speeds of the respective rollers 30 and 31 of the fixing device 15 are also accelerated. In order to cope with such acceleration, a pressing force of the pressuring roller 31 to the fixing roller 30 is set high. Thereby, because the soft fixing roller 30 is greatly deformed and a distance of the fixing nip N is lengthened, suitable toner fixing can be secured. However, in the fixing nip N, when the fixing side elastic layer 34 of the fixing roller 30 is greatly crushed, it is considered that there is likelihood causing problems, such as interfacial peeling of the fixing side elastic layer 34 from the fixing side core metal 33 and bending of left and right end parts (end parts in the axial direction) of the fixing belt 35.

In order to cope such problems, the fixing device 15 according to the embodiment has, as shown in FIG. 3, annular gaps 70 recessed from both end faces S1 in the axial direction to the inside of the fixing side elastic layer 34. The respective annular gaps 70 are recessed separate from the fixing side core metal 33 and fixing belt 35 along a circumference direction in the both end faces S1 in the axial direction of the fixing side elastic layer 34. Incidentally, because the both end parts in the axial direction of the respective rollers 30 and 31 have the respective roughly same shapes, in the following description, one end part will be focused.

The annular gap 70 is formed in a roughly intermediate part of the thickness of the fixing side elastic layer 34. The annular gap 70 is recessed in roughly parallel from the end face S1 to the inside of the fixing side elastic layer 34 and a bottom part 71 of the annular gap 70 has a semicircular section. That is, the annular gap 70 has a roughly U-shaped section and the end part of the fixing side elastic layer 34 is formed in an arch shape by the existence of the annular gap 70. Therefore, at the inside and outside in the radial direction the annular gap 70, the fixing side elastic layer 34 is provided so as to contact with the fixing side core metal 33 and fixing belt 35 at a predetermined thickness. Hereinafter, these parts contacting with the fixing side core metal 33 and fixing belt 35 are called as "elastic supporting parts 72".

The bottom part 71 of the annular gap 70 is configured so as to be positioned inside an end face S3 in the axial direction of the pressuring roller 31 (the pressuring side elastic layer 51 and pressuring side release layer 52).

As mentioned above, it is configured so that the length L1 in the axial direction of the fixing side elastic layer 34 is shorter than the length L2 in the axial direction of the fixing belt 35 and longer than the length L3 (L4) in the axial direction of the pressuring side elastic layer 51 (the pressuring side release layer 52). That is, they are formed so that the lengths in the axial direction are increased in order of the pressuring side elastic layer 51 (the pressuring side release layer 52), the fixing side elastic layer 34, the fixing belt 35 (L3(L4) <L1<L2). Because of this, an end face S2 of the fixing belt 35 is configured so as to be positioned outside the end face S3 of the pressuring roller 31. In addition, the end face S1 of the fixing side elastic layer 34 is configured so as to be positioned outside the end face S3 of the pressuring roller 31 and to be positioned inside the end face S2 of the fixing belt 35. Therefore, the elastic supporting part 72 outside in the radial direction is configured so as to support the end part of the fixing belt 35 and to be able to receive the pressing force from the pressuring roller 31. Incidentally, the elastic supporting part 72 inside in the radial direction contacts with the fixing side core metal 33.

Incidentally, a part between the bottom parts 71 of a pair of left and right annular gaps 70 becomes an available pressuring field D2 of the fixing nip N. The available pressuring field D2 is set to a length capable of carrying out the suitable fixing process to the sheet P with a maximum size allowing the image forming.

In accordance with the fixing device 15 according to the embodiment as described above, in the both end faces S1 of the fixing side elastic layer 34, the annular gaps 70 are recessed with leaving the part contacting with the fixing side core metal 33 and fixing belt 35 (the elastic supporting parts 72). That is, when the fixing roller 30 is viewed from the axial direction, the fixing side core metal 33, the fixing side elastic layer 34, the annular gap 70 (a space formed by this), the fixing side elastic layer 34, the fixing belt 35 are laminated. Moreover, the annular gaps 70 are recessed from the both end faces S3 to the inside in the axial direction of the pressuring roller 31. Because of this, the pressure applied to the both end parts in the axial direction of the fixing roller 30 by the pressuring roller 31 is not acted directly on an interface between the fixing side core metal 33 and fixing side elastic layer 34 by the existence of the annular gap 70. Thereby, stress concentration in the interface between the fixing side core metal 33 and fixing side elastic layer 34 can be restrained and the interfacial peeling of the fixing side elastic layer 34 from the fixing side core metal 33 can be restrained.

Moreover, in the both end parts of the fixing roller 30, the fixing side elastic layer 34 existing at the inside in the axial direction of the fixing belt 35 can receive the pressure applied by the pressuring roller 31. In particular, the both end faces S1 in the axial direction of the fixing side elastic layer 34 can suitably receive the pressure from the pressuring roller 31 because of positioning outside the both end faces S3 in the axial direction of the pressuring roller 31. Thereby, it is possible to restrain bending of the both end parts of the fixing belt 35 and to restrain damage caused by repeatedly receiving bending stress.

Incidentally, it is considered in the fixing nip N that the fixing side elastic layer 34 displaced in the axial direction contacts with an end part of the base material 40 (nickel) of the fixing belt 35 and is damaged. In this point, in accordance with the fixing device 15 according to the embodiment, since the both end faces S1 in the axial direction of the fixing side elastic layer 34 is positioned inside the both end faces S2 in the axial direction of the fixing belt 35, the both end parts in the axial direction of the fixing side elastic layer 34 are prevented from displacing in the axial direction and contacting with edges (the both end parts) of the fixing belt 35. Thereby, it is possible to effectively prevent the both end parts in the axial direction of the fixing side elastic layer 34 from being damaged.

Further, in accordance with the fixing device 15 according to the embodiment, since the bottom part 71 of the annular gap 70 has the semicircular section, the end part of the fixing side elastic layer 34 is formed in the arch shape. Because of this, it is possible to disperse the pressure applied to the end part of the fixing side elastic layer 34 from the pressuring roller 31 via the fixing belt 35. Thereby, it is possible to restrain the stress concentration and to prevent the fixing side elastic layer 34 consisting of the annular gap 70 from being damaged.

Moreover, in accordance with the color printer 1 including the fixing device 15 according to the embodiment described above, it is possible to restrain the interfacial peeling of the fixing side elastic layer 34 from the fixing side core metal 33 in the both end parts in the axial direction of the fixing roller 30 and to restrain the damage caused by repeatedly receiving bending stress in the both end parts in the axial direction of the fixing belt 35. Thereby, it is possible to achieve lifetime prolongation of the fixing roller 30. Because of this, it is possible to decrease the maintenance frequency of the fixing device 15 and to reduce cost required for replacement of the fixing roller 30 and others.

Incidentally, although the bottom part 71 of the annular gap 70 has the semicircular section in order to prevent the damage of the fixing side elastic layer 34, the present invention is not restricted by this. For example, if only the damage prevention of the fixing side elastic layer 34 can be secured, the bottom part 71 of the annular gap 70 may be formed so as to become a rectangular section or a triangular (V-shaped) section.

Incidentally, although illustration is omitted, the fixing belt 35 may be wound around the fixing roller 30 (the fixing side core metal 33 and fixing side elastic layer 34) and one or more other rollers (e.g. a tension roller).

While the preferable embodiment and its modified example of the fixing device and the image forming apparatus of the present invention have been described above and various technically preferable configurations have been illustrated, a technical range of the invention is not to be restricted by the description and illustration of the embodiment. Further, the components in the embodiment of the invention may be suitably replaced with other components, or variously combined with the other components. The claims are not restricted by the description of the embodiment of the invention as mentioned above.

What is claimed is:

1. A fixing device comprising:

a fixing roller having a fixing belt heated by a heat source around an outer circumference of an elastic layer provided around a core metal; and a pressuring roller provided so as to pressure-contact with the fixing roller and to form a fixing nip passing a recording medium having a toner image transferred through, wherein, in both end faces in an axial direction of the elastic layer, annular gaps are recessed separate from the core metal and fixing belt along a circumference direction, bottom parts of the annular gaps are configured so as to be positioned inside both end faces in the axial direction of the pressuring roller.

2. The fixing device according to claim 1, wherein both end faces in the axial direction of the fixing belt are configured so as to be positioned outside both end faces in the axial direction of the pressuring roller, both end faces in the axial direction of the elastic layer are configured so as to be positioned outside the both end faces in the axial direction of the pressuring roller and to be positioned inside the both end faces in the axial direction of the fixing belt.

3. The fixing device according to claim 1, wherein the bottom part of the annular gap has a semicircular section.

4. The fixing device according to claim 1, wherein in both end parts in the axial direction of the core metal, deviation preventing flanges extending to the outside in a radial direction are arranged, respectively, a length in the axial direction of the elastic layer is configured shorter than a distance between a pair of the deviation preventing flanges.

5. The fixing device according to claim 1, wherein surface hardness of the fixing roller is set lower than surface hardness of the pressuring roller.

6. An image forming apparatus comprising:

the fixing device according to claim 1.

* * * * *